US007645371B2

(12) United States Patent
Sa

(10) Patent No.: US 7,645,371 B2
(45) Date of Patent: Jan. 12, 2010

(54) PROCESS OF CERAMIC COATING FOR SILVER OR SILVER PLATED

(75) Inventor: Bok Jin Sa, Namyangju (KR)

(73) Assignee: HANA Co. Ltd., Seoul (KR)

( * ) Notice: Subject to any disclaimer, the term of this patent is extended or adjusted under 35 U.S.C. 154(b) by 60 days.

(21) Appl. No.: 11/987,837

(22) Filed: Dec. 5, 2007

(65) Prior Publication Data

US 2009/0145768 A1 Jun. 11, 2009

(51) Int. Cl.

| | |
|---|---|
| ***C23C 28/00*** | (2006.01) |
| ***C25D 5/52*** | (2006.01) |
| ***C25D 3/00*** | (2006.01) |

(52) U.S. Cl. ..... 205/195; 205/222; 205/261

(58) Field of Classification Search ..... 205/195, 205/222; 296/261

See application file for complete search history.

(56) References Cited

FOREIGN PATENT DOCUMENTS

JP 74001984 B * 1/1974

OTHER PUBLICATIONS

Price et al., "Protection of Silver by the Electrodeposition of Beryllia", J. of the Institute of Metals (no month, 1939), vol. 65, Advanced copy No. 844, 8 pp. 1 Page Abstract.*

* cited by examiner

*Primary Examiner*—Edna Wong
(74) *Attorney, Agent, or Firm*—GWiPS

(57) ABSTRACT

A process of ceramic coatings on silver or silver-plated articles is developed in order to prevent surface tarnish, which is employed as ornaments on bags, garments or accessories such as necklaces, earrings, etc. The process comprises the steps of: forming a beryllium film on the surface of the article by fixing a stainless steel plate to an anode, fixing the silver or silver-plated article to a cathode and plating the surface of the silver or silver-plated article with beryllium in an electrolyte containing beryllium sulfate ($BeSO_4.4H_2O$) by an electroplating method; buffing the article coated with the beryllium film; washing and drying the buffed article using a surfactant; forming the resultant ceramic coating by dipping the dried article in ceramic coating solution which includes 20 to 80 cc of glass water No. 1 (liquid sodium silicate), 5 to 60 g of sodium metasilicate, 5 to 30 g of sodium tungstate, 5 to 10 g of molybdic acid in 1 liter of water; and drying the wetted article.

3 Claims, No Drawings

PROCESS OF CERAMIC COATING FOR SILVER OR SILVER PLATED

BACKGROUND OF THE INVENTION

1. Field of the Invention

The present invention relates to a process for formation of ceramic coatings on silver and/or silver plated articles in order to prevent surface tarnish of the articles, which are usually applied to accessories or ornaments of bags and garments.

2. Related Prior Art

Metal finishing technologies have progressed to enhance the utility of metals and focus on efforts to protect metals from corrosion, improve appearance and decorative value of metal articles and expand the functions of metal.

Metal finishing methods which have been previously developed include: an electroplating or electro-deposition method to form a metal coating over another metal or non-metal material by electrical energy, in which an electrolyte plated subject is an anode while a plating metal is a cathode; a chemical plating method to form a metal coating on the surface of another metal or non-metal by chemical modification, which has no electrode and comprises substitution of metal ions to be plated; a dip-plating method to form a coating by dipping a metal subject into a molten metal bath containing the plating metal; a penetration plating method to form an alloy coating by diffusing and penetrating a metal into another metal; a metal spraying method to form a coating by spraying a molten metal over the surface of another metal; a chemical deposition method to coat metal compounds by evaporating volatile metal salt and thermally decomposing the surface of a subject to be plated; a cathode sputtering method to form a coating on the surface of a subject to be plated with granular cathode material by colliding the cathode material with cation particles under a vacuum condition; a vacuum vapor deposition plating method to form a coating by depositing metal ions on the surface of a metal or non-metal object under a vacuum condition; an ion plating method to form a coating on a cathode material by converting a metal or gas through glow discharging into cations and accelerating the cations; an anodizing treatment method to form a thicker surface oxidized coating for an oxidation potential metal, which comprises immersing a material to form the oxidation coating in a water soluble solution containing sulfuric acid, chromium oxalate, etc. to accelerate oxidation thereof; a chemical coating treatment method to form a coating composed of chromates, phosphates or the like on the surface of a metal, which is different from the anodizing treatment because of using the oxidized coating made of a different metal from the plated object; a painting method to apply paint to the surface of a metal; a lining method to cover the surface of a metal or non-metal substrate with any non-metal material such as rubber or a synthetic resin; a coating method to form a coating made of enamel (that is, ceramic), synthetic resin, etc.; and a surface hardening treatment method to increase the hardness of the surface of a metal by penetrating carbon or nitrogen into the surface of the metal. However, metal finishing methods are not limited to only these particular kinds.

As described above, a variety of surface treatment methods have been known in the related art. However, there have not yet been proposed improved and/or easily applicable metal plating methods that endow silver or silver-plated articles with improved surface hardness of more than 500 Rv according to the Micro Vickers hardness test while indefinitely retaining the original silver color and gloss, and that form a coating film made of a metal with excellent corrosion resistance.

Conventionally known chemical coating methods for improving the specific strength of a coating film cannot form transparent coatings. In addition, none of the various chemicals previously developed can with certainty allow fabrication of electroplated products using metals with transparency, high specific strength and excellent corrosion resistance.

In the case of a method for electroplating silver or silver-plated articles by dipping the articles in an electrolyte, it is difficult to manage an acid bath or alkali bath containing the electrolyte. In this field, there has been proposed an electro-deposition process, which is the most well known method, that dips a metal subject in an aqueous lacquer and dries the wetted subject, or that applies an oil-based lacquer to a metal subject and carries out thermosetting of the coated subject. Such electro-deposition processes are generally used for surface coating of automobile structures.

However, unlike in the case of silver, this process does not regard maintenance of original color and gloss of a base paint as an important goal, and can control the gloss using a lacquer. Accordingly, the electro-deposition process is expected to be adapted simply because of economic merit.

It is often observed that silver-plated ornaments attached to even a high quality bag, which was purchased merely a few months earlier, are visibly tarnished, or a bright silver based trophy is discolored in a little while in spite of being carefully stored in a glass box. Especially, when leather-made bags with silver or silver-plated ornaments are placed in an export container for transportation, discoloration or tarnish of the ornaments may sometimes be caused by chemical ingredients contained in the leather and/or temperature variation during the transportation before arriving at consumers, thereby causing a problem of damage to the value of goods.

Discoloration or tarnish of a silver or silver-plated article is mostly caused by chemical modification such as corrosive oxidation of the surface of the article. Silver generally forms a plurality of silver oxides including, for example, AgCl, $Ag_2S$, $Ag_2O$ and so on, and this means silver is a very susceptible metal to oxidation. In other words, silver is a lower level noble metal than other precious metals such as platinum, rhodium, palladium, gold and the like. Accordingly, this problem must be overcome in order to maximize the value of silver and silver plated articles.

SUMMARY OF THE INVENTION

Accordingly, the present invention is directed to solve the problems of conventional methods as described above and intended for silver products and/or silver-plated products which are usually used in fashion jewelry, costume jewelry, accessory items or parts thereof.

Such products are normally exposed to a number of different environments including, for example: hot and humid environments such as tropical regions; inclement weather conditions such as less than −50° C. or more than 60° C.; snow and rain, etc. They are sometimes in contact with leather or with automobile exhaust fumes, and may be exposed to any particular hot spring environment such as a sulfur spa.

Furthermore, silver or silver-plated products may be severely shocked or impacted, and may be repeatedly hit against or in contact with other substances such as overcoats, gloves, iron handrails or balustrades, chairs, desks, etc. and may be scratched. Briefly, the above described environments reflect all of the daily common incidents to be considered and, in view of these environments, silver or silver-plated products need superior properties including, for example, weatherproof properties, chemical resistance, abrasion resistance, impact resistance and the like.

Accordingly, an object of the present invention is to provide a novel process for formation of a ceramic coating on a silver or silver-plated article in order to prevent surface tarnish of the article, such that the coating can tolerate physically and chemically harsh environments and retain the original color and gloss of the article.

In order to improve corrosion resistance and abrasion resistance of a silver or silver-plated article, a chemical coating or painting method as described above has been generally used to form a fresh metal film, however, it is unable to preserve the inherent color and gloss of the silver.

For this reason, there was proposed another approach for enhancing corrosion resistance and abrasion resistance of a silver or silver-plated article, which includes coating of the article with a glass material. But, the glass material is susceptible to cracking even by a small impact and such cracks allow the surface of the article to be directly exposed to an environment causing discoloration or tarnish of the article.

Therefore, another object of the present invention is to provide a process for formation of a ceramic coating on a silver or silver-plated article in order to prevent surface tarnish of the article, such that the coating can protect the surface of the article from generation of cracks through flexibility even when the article is exposed to specific environments with the potential to cause surface tarnish of the article.

In order to achieve the objects described above, the present invention provides a process for formation of a ceramic coating on a silver or silver-plated article to prevent surface tarnish of the article comprising the steps of: forming a beryllium film on the surface of the article by fixing a stainless steel plate to an anode, fixing the silver or silver-plated article to a cathode and plating the surface of the silver or silver-plated article with beryllium in an electrolyte containing beryllium sulfate ($BeSO_4.4H_2O$) by an electroplating method; buffing the article coated with the beryllium film; washing and drying the buffed article using a surfactant; forming the resultant ceramic coating by dipping the dried article in a ceramic coating solution which includes 20 to 80 cc of glass water No. 1 (liquid sodium silicate), 5 to 60 g of sodium metasilicate, 5 to 30 g of sodium tungstate, 5 to 10 g of molybdic acid in 1 liter of water; and then drying the wetted article.

According to the present invention, the silver or silver-plated article having the ceramic coating does not belie any traces or marks of the ceramic coating. That is, the present inventive article is completely and clearly coating-treated so that it is substantially impossible to determine whether the article has the ceramic coating by simply observing the article visually.

There are a number of illustrative examples and preferred embodiments of silver or silver-plated articles with ceramic coatings according to the present invention, which mostly display no tarnish or discoloration even one (1) year after coating except in special cases.

Especially, as a result of constant temperature and humidity experiments which were performed by placing the treated article, that is, the silver or silver-plated article with a ceramic coating along with a piece of leather material in a constant temperature and humidity chamber at 80° C. with humidity of 80%, no alteration of the article noted above was observed.

Consequently, the present inventive article can be put on items which will then exhibit and retain high quality for a long duration by continuously maintaining the original conditions of the article as manufactured.

DETAILED DESCRIPTION OF THE INVENTION

Hereinafter, the present invention will be more particularly described by the preferred embodiments. However, these are intended to illustrate the invention as preferred embodiments of the present invention and do not limit the scope of the present invention.

The process for formation of a ceramic coating on a silver or silver-plated article includes the steps of: forming a transparent metal film with high hardness based on beryllium metal on the surface of the article in order to assist a top ceramic coating without influence of a base plating; pretreating the formed beryllium metal film by buffing the film and washing the buffed film; and forming a glass (or ceramic) coating on the surface of the article coated with the beryllium film.

However, the glass (or ceramic) coating formation process is applicable in the same manner for either silver articles or silver-plated articles. This process substantially includes three steps of: forming a beryllium film on the surface of a silver or silver-plated article; pre-treating the surface of the article to form a ceramic coating on the surface of the article; and forming the ceramic coating on the article.

1) Formation of beryllium film on silver or silver-plated article:

Pre-treatment: rinse surface of an article to be plated after washing the same sufficiently with surfactant Beryllium plating Preparation of an electrolyte:

To 1 liter of water,

Beryllium sulfate $BeSO_4.4H_2O$ in the amount of 2.4 g/l, and

Ammonium hydroxide (aqueous ammonia) in the amount of 5 to 10 g/l are added and the pH value of the mixture is adjusted to pH 5.7 to 5.8 with ammonia water to prepare an electrolyte.

A stainless steel plate was fixed to an anode while a silver or silver-plated article is fixed to a cathode in the above prepared electrolyte under a current density of 5 mA/dL, followed by electroplating of the article for 0.5 to 1 minute to form a beryllium film on the surface of the article.

2) Pre-treatment of silver or silver-plated article:

On the grounds that surface lubrication of silver or silver-plated products is very important in a ceramic coating process, the silver or silver-plated article coated with the beryllium film described above sufficiently undergoes a buffing process and is washed using a surfactant then completely dried.

3) Preparation of ceramic coating solution and ceramic coating process:

Before beginning the ceramic coating process, ceramic coating solutions are prepared with respective compositions defined as follows:

Coating solution for a thin coating with thickness of 3 to 5 μm

To 1 liter of water,

Glass water No. 1 (liquid sodium silicate) in the amount of 20 to 30 cc/l,

Sodium metasilicate in the amount of 5 to 10 g/l,

Sodium tungstate in the amount of 5 g/l, and

Molybdic acid 5 g/l are added.

Coating solution for moderate coating with thickness of 6 to 10 μm

To 1 liter of water,

Glass water No. 1 (liquid sodium silicate) in the amount of 40 to 50 cc/l,

Sodium metasilicate in the amount of 20 to 30 g/l,

Sodium tungstate in the amount of 10 g/l, and

Molybdic acid in the amount of 78 g/l are added.

Coating solution for thick coating with thickness of 10 to 15 μm

To 1 liter of water,

Glass water No. 1 (liquid sodium silicate) in the amount of 60 to 80 cc/l,

Sodium metasilicate in the amount of 40 to 60 g/l,

Sodium tungstate in the amount of 30 g/l, and

Molybdic acid in the amount of 10 g/l are added.

From the above compositions, molybdic acid, sodium tungstate and sodium metasilicate are represented by $Na_2MoO_4$, $Na_2WO_4$ and $Na_2SiO_3$, respectively, and the glass water No. 1 is a mixture of 36 to 38 wt. % of $SiO_2$, 17 to 18 wt. % of $Na_2O$, 0.05 wt. % of $Fe_2O_3$ and the balance of insoluble precipitates (mostly sticky organics).

During preparation of the ceramic coating solution, pure water was preferably used and heated to about 50° C. The above ingredients were placed in the heated water in order and sufficiently agitated before use.

The silver or silver-plated article suspended on a rack was dipped in a bath containing any one of the ceramic coating solutions prepared as described above. After agitating the article in the bath enough to desirably coat the article with the solution, the coated article was taken out of the bath and instantly dried at 100 to 150° C. using a hot air dryer. In this case, it will be noted that the article must be wetted in full with the solution and/or sufficiently agitated in the solution, otherwise the article has a rough or unevenly coated surface or is susceptible to cracks.

While the present invention has been described with reference to the preferred embodiments, it will be understood by those skilled in the art that various modifications and variations may be made therein without departing from the scope of the present invention as defined by the appended claims.

What is claimed is:

1. A process for formation of a ceramic coating on a silver or silver-plated article to prevent surface tarnish of the article, comprising the steps of:

forming a beryllium film on the surface of the article by fixing a stainless steel plate to an anode, fixing the silver or silver-plated article to a cathode, and plating the surface of the silver or silver-plated article with beryllium in an electrolyte containing beryllium sulfate ($BeSO_4.4H_2O$) by an electroplating method;

buffing the article plated with the beryllium film, and washing and drying the buffed article using a surfactant; and forming a resultant ceramic coating by dipping the dried article in a ceramic coating solution which includes 20 to 80 cc of liquid sodium silicate (glass water No. 1), 5 to 60 g of sodium metasilicate, 5 to 30 g of sodium tungstate, 5 to 10 g of molybdic acid in 1 liter of water, and drying the wetted article.

2. The process according to claim 1, wherein the beryllium sulfate electrolyte is prepared by adding 2.4 g of beryllium sulfate and 5 to 10 g of ammonium hydroxide to 1 liter of water and the pH value of the electrolyte is adjusted to pH 5.7 to 5.8 by altering the amount of ammonium hydroxide.

3. The process according to claim 1, wherein the liquid sodium silicate (glass water No. 1) is a mixture of 36 to 38 wt. % of $SiO_2$, 17 to 18 wt. % of $Na_2O$, 0.05 wt. % of $Fe_2O_3$ and the balance of insoluble precipitates (mostly sticky organics).

* * * * *